United States Patent [19]

Wrigley

[11] Patent Number: 4,901,462

[45] Date of Patent: Feb. 20, 1990

[54] LUGGAGE TAG

[76] Inventor: Marilyn F. Wrigley, 3746 Harrison, Kansas City, Mo. 64109

[21] Appl. No.: 98,605

[22] Filed: Sep. 18, 1987

[51] Int. Cl.[4] ..... G09F 3/14

[52] U.S. Cl. ..... 40/665; 40/299; 70/456 R

[58] Field of Search ..... 40/299, 20 R, 5, 6, 40/10 R; 70/456 R, 457; 206/37.1, 37.3; 190/102; 112/439; 446/227; 283/80

[56] References Cited

U.S. PATENT DOCUMENTS

| | | | |
|---|---|---|---|
| 2,591,379 | 4/1952 | Schradermeier | 446/74 |
| 3,908,418 | 9/1975 | Stoffel | 70/457 |
| 4,187,628 | 2/1980 | Thompson | 428/13 |
| 4,358,944 | 11/1982 | Stoffel | 70/457 |
| 4,457,425 | 7/1984 | Cooper et al. | 40/621 |

FOREIGN PATENT DOCUMENTS

| | | | |
|---|---|---|---|
| 2139945 | 2/1973 | Fed. Rep. of Germany | 40/21 R |

*Primary Examiner*—Gene Mancene
*Assistant Examiner*—Michael Lynch
*Attorney, Agent, or Firm*—Jerry T. Kearns

[57] ABSTRACT

A luggage tag is formed from a soft hollow plastic body portion. The plastic may be treated with a photophorescent material so that the luggage tag will glow in the dark. The hollow plastic body portion has a central opening covered by a removable monogrammed cap. The cap covers a key shaped recess designed to hold a suitcase key. A resilient plastic circular loop clip is connected to the body portion for attaching the luggage tag to an article of luggage. In a second embodiment, the body portion is formed from open mesh plastic through which yarn is woven. The body portions may be formed as a variety of shapes including a teddy bear, a flower, a human foot, and any letter of the alphabet.

1 Claim, 4 Drawing Sheets

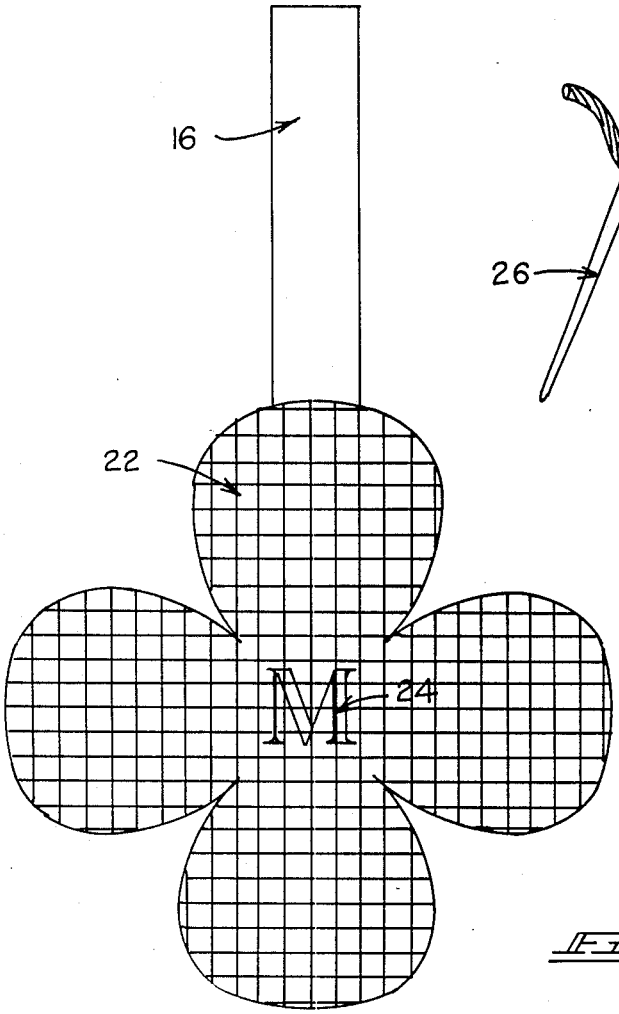
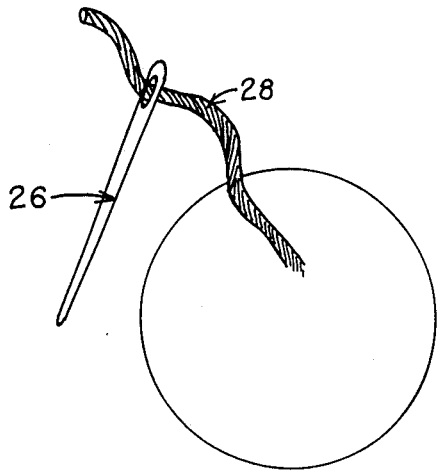
FIG 5
FIG 4

LUGGAGE TAG

BACKGROUND OF THE INVENTION

1. Field of the Invention

The present invention relates to luggage tags, and more particularly pertains to embodiments of a neW and improved luggage tag. Many travelers utilizing public transportation such as airlines, buses and trains carry similar articles of luggage. Confusion is often created in distinguishing between these similar articles of luggage. In order to enable travelers to easily distinguish their luggage, the present invention provides a distinctive personalized luggage tag.

2. Description of the Prior Art

Various types of luggage tags are known in the prior art. A typical example of such a luggage tag is to be found in U.S. Pat. No. 53,360, which issued to G. Thomas on Mar. 20, 1866. This patent discloses a luggage tag which consists of a plurality of disks which are rotatably fastened together. By turning these disks, the traveler's destination may be indicated. The disks are secured in the adjusted rotary position by insertion of a strap through registering slots in the disks. This same strap is utilized to secure the luggage tag to an article of luggage. U.S. Pat. No. 116,667, which issued to F. Bellerive on July 4, 1871, discloses a leather luggage tag having a window for display of identifying information and having a looped attaching strap. U.S. Pat. No. 207,962, which issued to W. Guy on Sept. 10, 1878, discloses a luggage tag which comprises a circular disk which is pivotally attached at a central portion to a luggage attaching strap. A series of holes are circumferentially arranged at the edge of the disk. A destination is printed on the disk adjacent each hole. A cord which is secured to the attaching strap is passed through the hole in a disk corresponding to the traveler's destination. U.S. Pat. No. 262,696, which issued to C. Russell on Aug. 15, 1882, discloses a luggage check in which a flanged baggage check ticket holder is utilized in conjunction with a luggage attaching strap. The luggage attaching strap has an enlarged end portion which, when the strap is passed through a loop in the flange holder, serves to secure the holder to the attaching strap. U.S. Pat. No. 297,860, which issued to C. Smith on April 29, 1884, discloses a luggage tag which has a circular disk pivotally connected to an attaching bracket. A plurality of detents are circumferentially arranged about the periphery of the disk. A destination corresponding with each detent is printed on the face of the disk. A cooperating detent mechanism is formed on the attaching bracket. By rotating the disk to the desired position, the traveler's destination will be displayed through a slot provided in the attaching bracket. U.S. Pat. No. 2,556,825, which issued to H. Smith on June 12, 1951, discloses a luggage tag consisting of a frame having opposed transparent plastic windows. In use, the frame displays identifying information pertaining to the traveler. An attaching strap is received through a grommet in the luggage tag frame. U.S. Pat. No. 3,788,540, which issued to D. Sammons on Jan. 29, 1974, discloses a travel envelope for enclosing an airline ticket which includes as an integral part thereof a baggage ticket which may be torn away and attached to the baggage of the traveler with a string. A baggage claim ticket is also detachably connected to the envelope. Duplicate indicia are applied to both the baggage ticket and baggage claim ticket for identifying purposes. U.S. Pat. No. 3,965,598, which issued to J. Avery on June 29, 1976, discloses a luggage tag consisting of a stippled base sheet with a coating having a different color than the color of the base material. When selected stipples are cut off, letters, numbers or other indicia may be formed of a color of the base material in a background of the color of the coating. A slot is formed for receiving a luggage attaching strap. U.S. Pat. No. 4,180,284, which issued to J. Ashley on Dec. 25, 1979, discloses a luggage identifying tag which consists of a tag arranged for attachment to a piece of luggage and having located on its face one of a selected group of distinctive geometrical shapes which is colored in one of a selected group of colors and which has an alphanumeric character located within the borders of the geometrical shape. Thus, by having a large group of shapes, colors and alphanumeric characters, a very large number of identifying indicia is available, each of which is readily differentiable even at a distance by an untrained observer.

While the above mentioned devices are suited for their intended usage, none of these devices provides a luggage tag which is attachable to an article of luggage by a circular resilient plastic clip. Further, none of the aforesaid luggage tags utilizes a plastic body portion selected from easily identifiable shapes. Additionally, none of the prior art luggage tags described above utilize a glow in the dark plastic body portion. Another feature of the luggage tag of the present invention not disclosed by the previously described prior art luggage tags, is the use of a hollow plastic luggage tag having a removable monogrammed cap which covers a key shaped recess designed for reception of a suitcase key. Inasmuch as the art is relatively crowded with respect to these various types of luggage tags, it can be appreciated that there is a continuing need for and interest in improvements to such luggage tags, and in this respect, the present invention addresses this need and interest.

SUMMARY OF THE INVENTION

In view of the foregoing disadvantages inherent in the known types of luggage tags now present in the prior art, the present invention provides an improved luggage tag. As such, the general purpose of the present invention, which will be described subsequently in greater detail, is to provide a new and improved luggage tag which has all the advantages of the prior art luggage tags and none of the disadvantages.

To attain this, representative embodiments of the concepts of the present invention are illustrated in the drawings and make use of a soft resilient plastic hollow body portion having an opening covered by a removable monogrammed cap. The present invention also contemplates the provision of a key shaped recess for storage of a suitcase key beneath the removable cap. An additional feature of the present invention is the use of a glow in the dark plastic body portion. A further feature of the present invention is the use of a resilient circular plastic clip for quickly attaching the luggage tag of the present invention to an article of luggage. In a second embodiment of the present invention, the luggage tag body portion is formed from an open mesh plastic material through which is woven yarn of any desired color. The luggage tags of the present invention may be formed from a variety of easily recognizable shapes in a variety of distinctive colors.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved luggage tag which has all the advantages of the prior art luggage tags and none of the disadvantages.

It is another object of the present invention to provide a new and improved luggage tag which may be easily and efficiently manufactured and marketed.

It is a further object of the present invention to provide a new and improved luggage tag which is of a durable and reliable construction.

An even further object of the present invention is to provide a new and improved luggage tag which is susceptible of a low cost of manufacture with regard to both materials and labor, and which accordingly is then susceptible of low prices of sale to the consuming public, thereby making such luggage tags economically available to the buying public.

Still yet another object of the present invention is to provide a new and improved luggage tag which provides in the apparatuses and methods of the prior art some of the advantages thereof, while simultaneously overcoming some of the disadvantages normally associated therewith.

Still another object of the present invention is to provide a new and improved luggage tag which is formed from a soft plastic glow in the dark material.

Yet another object of the present invention is to provide a new and improved luggage tag which has a hollow body portion provided with a removable monogrammed cap which covers a key shaped recess designed for the reception of a suitcase key.

Even still another object of the present invention is to provide a new and improved luggage tag which is formed from a plastic mesh material through which a variety of colors of yarn may be woven.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a view of a luggage tag according to a second embodiment of the present invention, constructed from open mesh plastic material.

DESCRIPTION OF THE PREFERRED EMBODIMENT

Figure 1:
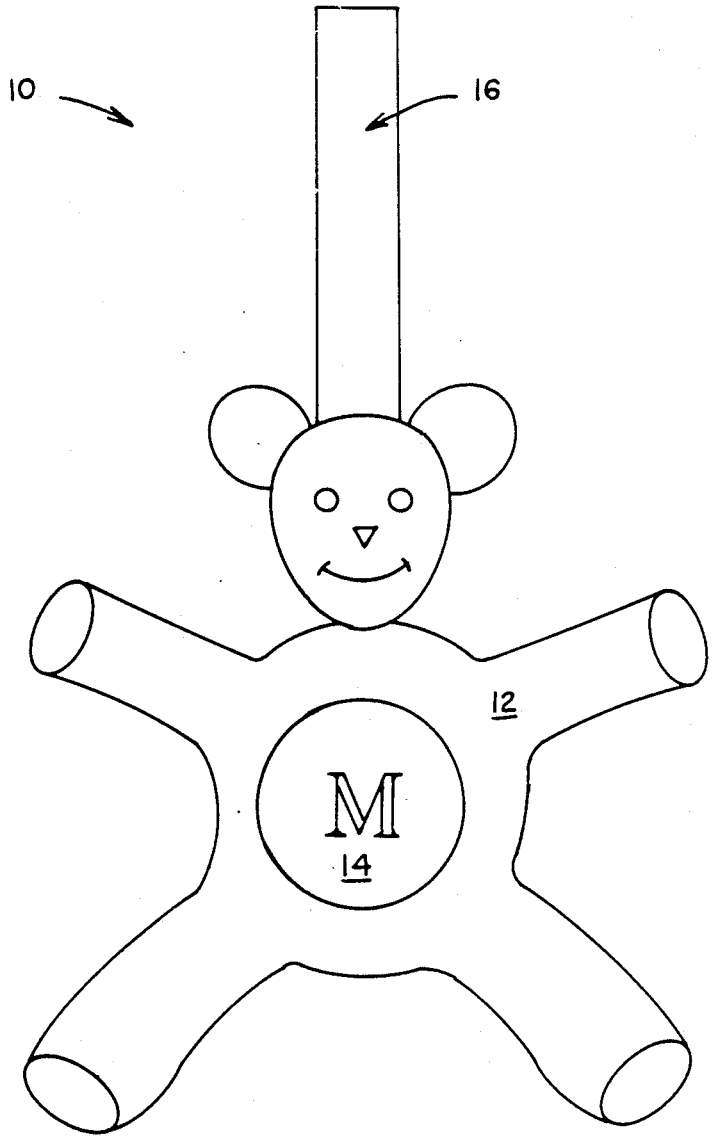
FIG. 1 is a plan view of a luggage tag according to a first embodiment of the present invention.

With reference now to the drawings, and in particular to FIG. 1 thereof, a new and improved luggage tag embodying the principles and concepts of the present invention and generally designated by the reference numeral 10 will be described.

More specifically, it will be noted that the first embodiment 10 of the invention includes a soft plastic body portion 12 which is impregnated with a phosphorescent material so that it will glow in the dark. A monogrammed snap on cap 14 covers a central opening in the hollow plastic body portion 12. A circular flexible plastic clip is attached to the body portion 12 and serves to attach the luggage tag to an article of luggage.

Figure 2:
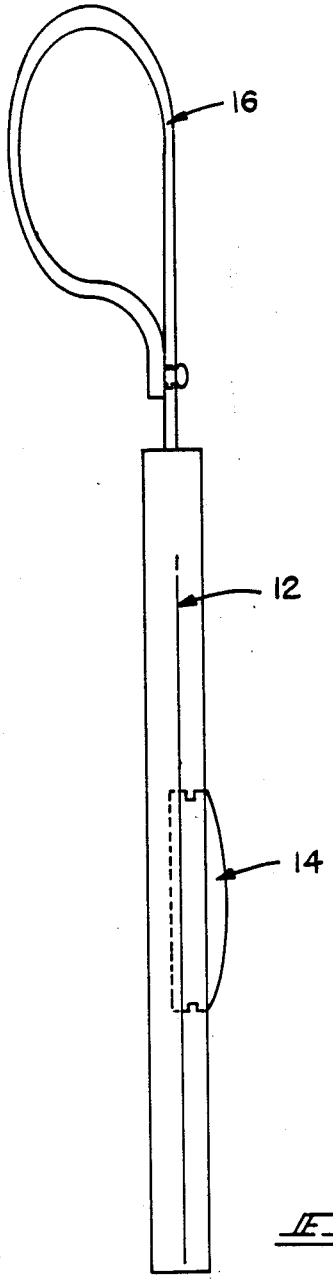
FIG. 2 is a side view of the luggage tag of FIG. 1.

With reference now to FIG. 2, a side view of the luggage tag of FIG. 1 is provided. The construction of the loop shaped flexible plastic clip 16 may be easily discerned. It should also be noted that the removable flexible plastic snap on cap 14 projects slightly above the front surface of the body portion 12. This enables the cap to be easily grasped and removed.

Figure 3:
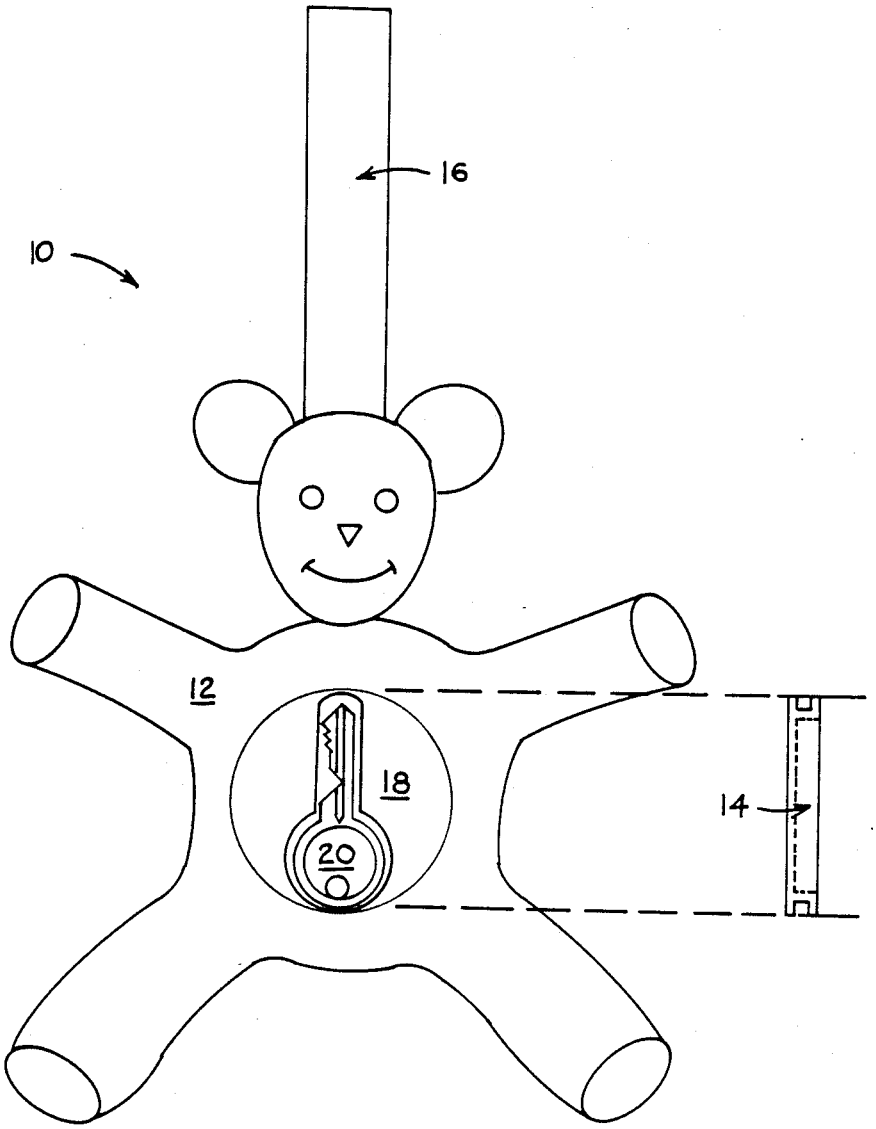
FIG. 3 is a plan view of the luggage tag of FIG. 1 with the removable monogrammed cap removed, revealing the key shaped recess.

With reference now to FIG. 3, a view of the luggage tag of FIG. 1, with the cap 14 removed is provided. A key shaped recess 20 is provided within the hollow interior 18 of the body portion 12. This recess is designed for storage of a suitcase key. As can be seen from the side view of the removable cap 14, a circular peripheral groove is provided for engaging the body portion 12, thus securing the flexible cap 14 in position. Thus, by removing the cap 14, a suitcase key may be stored in the key shaped recess 20. Further, the removable cap 14 is provided with a monogram which may be selected from a wide variety of initials and designs. It is contemplated that the caps will be marketed separately from the body portion, thus enabling the user to personalize the luggage tag of the present invention.

With reference now to FIG. 3, a luggage tag according to a second embodiment of the present invention is illustrated. This luggage tag consists of a body portion 22 constructed of an open mesh plastic material. A monogram 24 may be formed in the open mesh plastic body portion 22 by use of a needle 26 in conjunction with conventional yarn 28. A clip 16, identical to that described previously, is connected to the body portion 22. It is contemplated that the luggage tag of FIG. 3 will be marketed as a needlepoint kit, enabling the user to complete the kit according to their own personal tastes. The completed luggage tag is formed by weaving the yarn 28 through the open mesh plastic body portion 22, until the desired pattern is obtained. The luggage tag is then ready for use by attaching it to an article of luggage by use of the resilient clip 16.

The luggage tags of both the FIG. 1 and FIG. 3 embodiments may be constructed of body portions resembling a teddy bear, a flower, any letter of the alphabet, a foot shape, or any other distinctive shape. It will be noted that, through the use of these distinctive shapes and by utilizing bright colors, the luggage tags of the present invention will enable travelers to easily identify their luggage.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An ornamental luggage tag, comprising:

a soft flexible plastic hollow body portion configured as a teddy bear;

said body portion being treated with a phosphorescent material whereby it will glow in the dark;

a central circular opening in said body portion;

a soft plastic cylindrical flexible cap removably covering said opening;

said cap having a circular peripheral groove for engaging said body portion, an upper portion of said cap disposed above an upper surface of said body portion when said cap is engaged over said opening;

identifying indicia formed on said cap;

a key shaped recess formed within said hollow body portion, said key shaped recess dimensioned for close conformance and frictional engagement with a suitcase key, said key shaped recess covered by said cap;

and a resilient plastic circular loop clip connected to said body portion for attaching said luggage tag to an article of luggage.

* * * * *